United States Patent [19]

Beasley et al.

[11] Patent Number: 4,510,697

[45] Date of Patent: Apr. 16, 1985

[54] MICROWAVE CLOTHES DRYER

[76] Inventors: Gary Beasley, c/o George Spector, 3615 Woolworth Bldg., 233 Broadway; George Spector, 3615 Woolworth Bldg., 233 Broadway, both of New York, N.Y. 10007

[21] Appl. No.: 459,366

[22] Filed: Jan. 19, 1983

[51] Int. Cl.[3] ..... F26B 23/04

[52] U.S. Cl. ..... 34/1; 34/133; 219/10.55 R

[58] Field of Search ..... 34/133, 1, 4; 68/142, 68/144; 219/10.55 R

[56] References Cited

U.S. PATENT DOCUMENTS 4,007,546 2/1977 Sauer ..... 34/242

4,057,907 11/1977 Rapino et al. ..... 34/133

*Primary Examiner*—Larry I. Schwartz

[57] ABSTRACT

A microwave clothes dryer, including a housing around a rotating tumbler, a pivoted door on a front of the housing having a microwave heater on its inner side, and the tumbler being changeable in shape as it rotates.

3 Claims, 2 Drawing Figures

10
11
12
13
14
15
16
17
18
19
20
21
22
23
24
25
26
27
28
29
30
31
32
33
M 15
24
25
26
29

MICROWAVE CLOTHES DRYER

This invention relates generally to clothes dryer machine of tumbler type.

It is well known that such machines include a heat source for blowing hot air through the tumbling clothing, such heat source usually comprising a flame of natural gas. Usually a fully loaded machine requires one half of an hour for drying the clothing, during which time the natural gas continues to be burned.

An object of the present invention is to provide a clothes dryer which instead of using natural gas, utilizes microwave energy, so that the drying operation may be accomplished more quickly and at the same time accordingly requires less energy.

Figure 1:
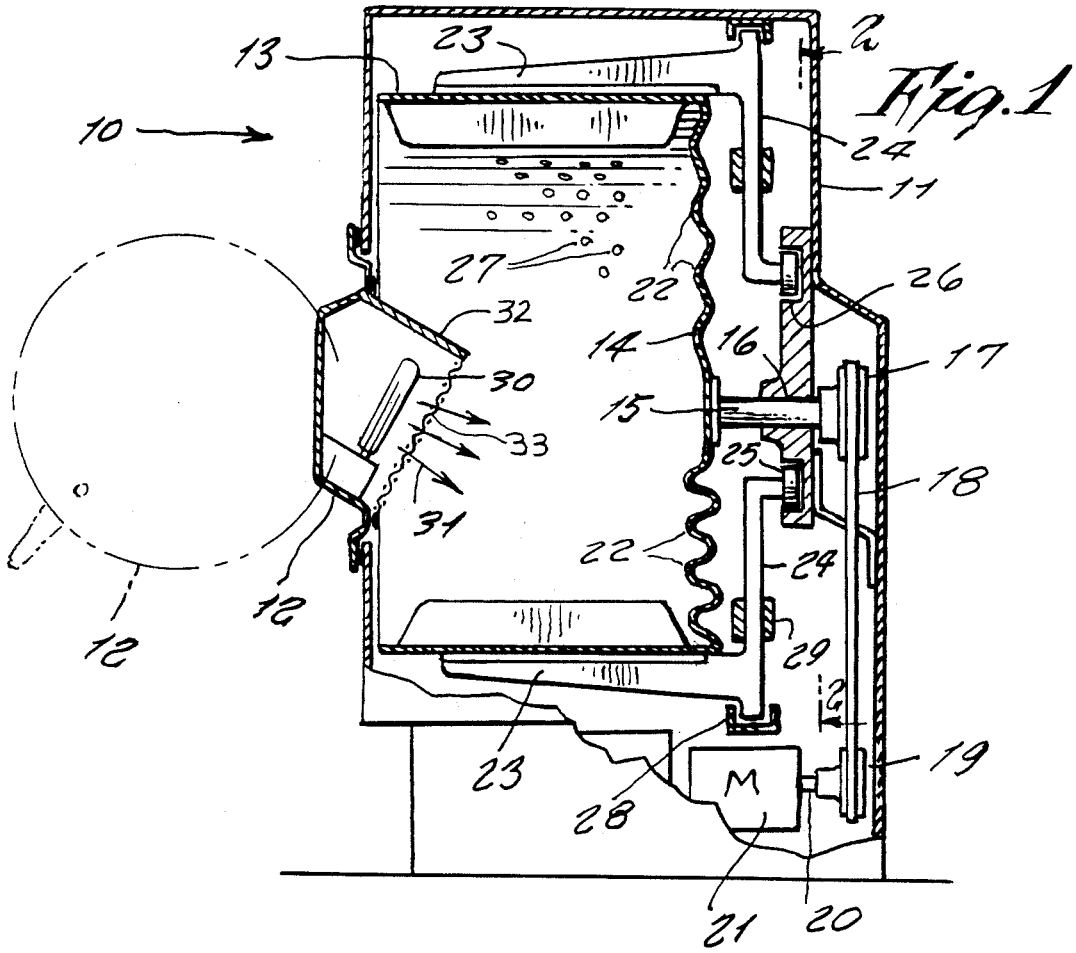
FIG. 1 is a side cross sectional view of a clothes dryer which includes a microwave heater mounted on the door, and also showing a drum that is variable in shape during rotation for improved drying action.
Figure 2:
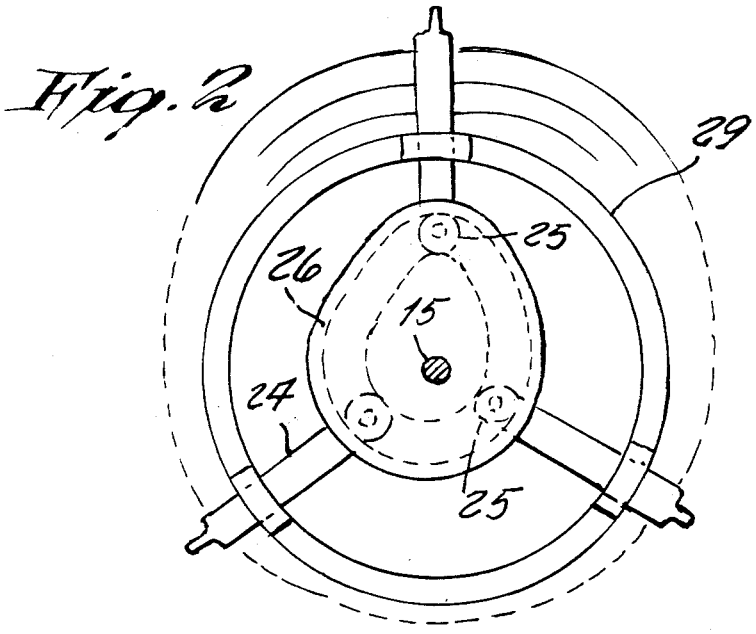
FIG. 2 is a view in direction 2—2 of FIG. 1, shown fragmentarily.

Referring now to the drawing in greater detail, the reference numeral 10 represents a microwave clothes dryer, according to the present invention, wherein there is a machine housing 11 having an outwardly pivotable door 12 on its front side for loading and unloading clothing into and out of the machine.

A generally cylindrical tumbler 13 is supported rotatably inside the housing by a rear wall 14 of the tumbler being attached to a shaft 15 journalled in a stationary bearing 16 of the housing and being rotated by a pulley 17 on a shaft 15 being engaged by endless belt 18 passes around a pullay 19 on a motor shaft 20 of an electric motor 21. A front side of the tumbler is left open for providing access thereinto from the door 12.

In the present invention the tumbler rear wall 14 is made with a plurality of concentric, circular corrugations 22 so as to allow the tumbler to be deformed from its cylindrically circular shape to an eliptical or oval shape by having its upper end lifted upwardly as the tumbler rotates, by means of three equally spaced apart ribs 23 secured to the outer side of the tumbler, the ribs being integral with arms 24 each of which has a roller 25 pivoted on its end, and which travel in an eliptical groove 26 on the stationary housing. This changing or upwardly enlarging of the tumbler cause the air inside the tumbler to squeeze in and out of the tumbler through the heat vent holes 27 so as to aid better air circulation through the tumbler so to dry the clothing quicker and more thoroughly. A channel 28 guides the ends of the rotating arms and a circular guide 29 rotating together with the arms, guides them so to extend radially as they travel.

In this invention, a microwave heater 30 is mounted on the inner side of the door so as to radiate microwave 31 toward the clothing tumbler in the tumbler. Whenever the door is opened, the electric circuit to the microwave heater is automatically cut off to prevent burning a person reaching into the tumbler, whenever the door is opened up. The heater accordingly is in electric circuit with a switch activated by the position of the door in a door opening of the housing.

The microwave unit 47 is mounted below a shield 32 and a protective screen 33 is positioned in front of unit 30.

While various changes may be made in the detail construction, it is understood that such changes will be within the spirit and scope of the present invention as is defined by the appended claims.

What is claimed:

1. A microwave clothes dryer, comprising in combination,a housing having a door on its front side, a flexible tumbler secured to a shaft inside said housing, said tumbler being formed of material allowing for shape change of said tumbler as it rotates and a microwave heater on an inner side of said door for radiating microwaves toward clothes inside said tumbler, said shaft being rotatably driven by a motor, wherein said tumbler includes a flexible rear wall and a flexible cylindrical side wall whereby said cylindrical side wall is attached to transverse ribs integral with arms that transcribe an elliptical course, said shaft being secured to said rear wall.

2. The combination as set forth in claim 1, wherein said micro wave heater is in electrical circuit with a switch that opens up whenever said door is opened up.

3. The combination of claim 1, wherein said arms are moveably mounted on an elliptical track concentrically fixed about the shaft center.

* * * * *